US005888000A

United States Patent [19]

Yasuoka

[11] Patent Number: 5,888,000

[45] Date of Patent: Mar. 30, 1999

[54] PRINTER WITH AUTOMATED MEANS FOR CHANGING PAPER CLAMPING PRESSURE

[76] Inventor: Tadashi Yasuoka, 1-1, Taihei 4-chome, Sumida-ku, Tokyo, Japan

[21] Appl. No.: 574,972

[22] Filed: Dec. 19, 1995

[30] Foreign Application Priority Data

Dec. 19, 1994 [JP] Japan ..... 6-315348

[51] Int. Cl.[6] ..... B41J 13/02

[52] U.S. Cl. ..... 400/636.3; 400/637

[58] Field of Search ..... 400/578, 592, 400/605, 629, 636, 636.1, 636.3, 637, 637.1

[56] References Cited

U.S. PATENT DOCUMENTS

| | | | |
|---|---|---|---|
| 5,020,929 | 6/1991 | Funamoto et al. | 400/636.1 |
| 5,030,024 | 7/1991 | Seshimo | 400/636.1 |
| 5,486,061 | 1/1996 | Kakuguchi | 400/605 |
| 5,681,124 | 10/1997 | Yasuoka | 400/636.1 |
| 5,746,525 | 5/1998 | Sanda et al. | 400/605 |

*Primary Examiner*—Ren Yan

*Attorney, Agent, or Firm*—Amster Rothstein & Ebenstein

[57] ABSTRACT

In the present invention, the pressure between the paper feed roller and the trailing roller can be changed while preventing possibility of human misoperation and without requiring exclusive motors. The paper support pressure between a paper feed roller and a trailing roller for clamping and conveying paper is changed by a friction switching mechanism. The drive force of a paper feed motor 60 for driving the paper feed roller is transmitted to said friction switching mechanism via a clutch mechanism C1. Whether the clutch mechanism C1 is connected or disconnected depends on the direction of the drive force of a ribbon feed motor 38 which drives the ink ribbon. When the ribbon driving motor 38 drives in reverse (anti-clockwise direction), an interlinked fan-shaped gear 94 rotates clockwise, a connecting bar 95 is displaced causing a cam 97*b* to also be displaced resulting in a pinion 63*b* and gear 72 to be engaged and interfitted with the clutch mechanism C1. Consequently, the rotation of the paper feed motor 60 is transmitted to the gear 72. By means of the rotation of the gear 72, the slide lever of the friction switching mechanism is slid, the rocking lever for supporting the trailing roller is rocked, and the paper supporting pressure between the rollers is changed.

4 Claims, 15 Drawing Sheets

12
101
108
111
109a
109
113
112
C2
110
109a
108
101
111
111a
109
110
62a
62
101
90
9
106
104a
103
103a
105
104
100
100b
101
102
100a
101
111a
113
112
C2
110
101
111a
110
90
101
101
103
105
100b
100a
109a
111a
101
C2
110
111a
109a
110
90
101
106
104
100b
101
100a

FIG. 15 (A)
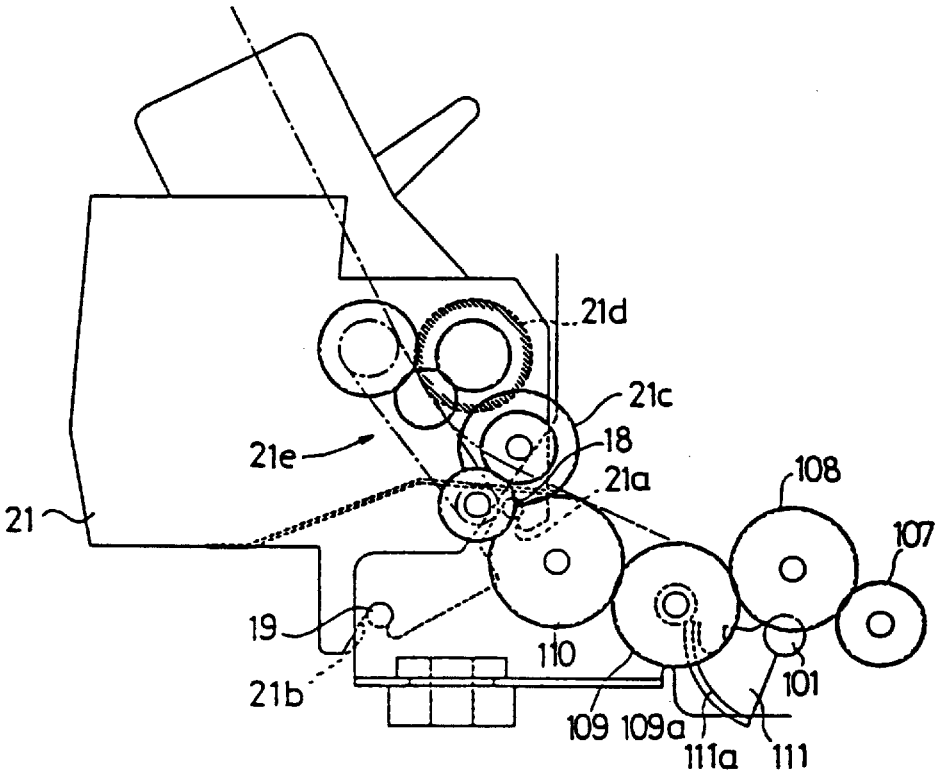
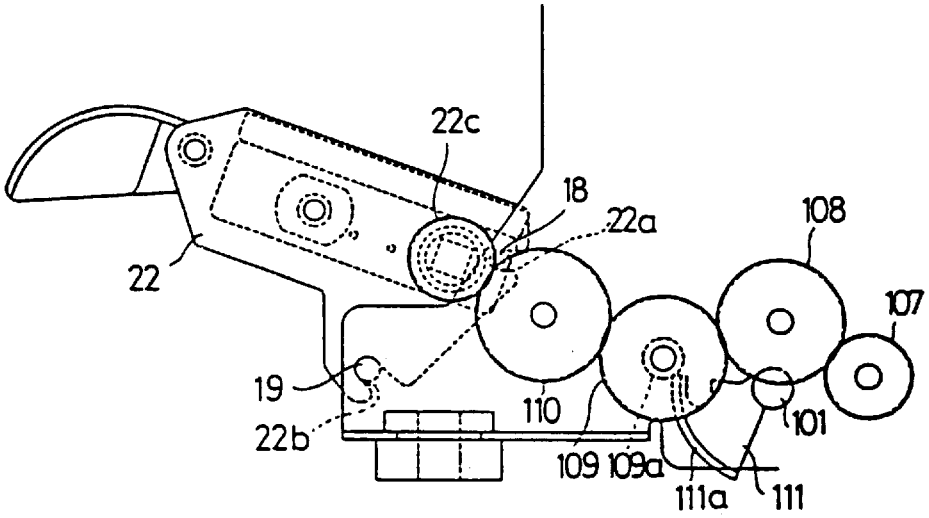
FIG. 15 (B)

PRINTER WITH AUTOMATED MEANS FOR CHANGING PAPER CLAMPING PRESSURE

BACKGROUND OF THE INVENTION

The present invention relates to a printer.

Among conventional printers, there are printers in which the pressure between the paper feed roller and the trailing roller can be changed depending on the type of paper. The pressure can be changed either by hand or automatically by means of exclusive motors.

However, in such prior art printers, paper feed defects occur due to misoperation in printers which change pressure by hand operation. In printers which have been automated by exclusive motors, the costs are high due to the necessity for an exclusive motor.

SUMMARY OF THE INVENTION

Given the above, the object of the present invention is to provide a printer in which misoperations while changing the pressure between the paper feed roller and the trailing roller can be prevented without requiring motors that exclusively change this pressure. The present invention comprises: a paper feed roller and a trailing roller for clamping and conveying paper, a friction switching mechanism for changing the paper clamping pressure between the two rollers, a paper feed motor for driving the paper feed roller, a clutch mechanism for transmitting the driving force of the paper feed motor to the friction switching mechanism, a ribbon feed motor for driving an ink ribbon inserted between a printing head and a platen, and a drive force transmission mechanism for transmitting an inverse driving force of the ribbon feed motor to the clutch mechanism.

The friction switching mechanism of one embodiment of the present invention is comprised of a rockably and displaceably supported switching lever connected to the trailing roller and a slide lever having a cam engaged with the switching lever for supporting and regulating the rocking of the switching lever in a plurality of rocking positions. This slide lever is driven by the driving force of the paper feed roller via the clutch mechanism.

The ribbon feed motor of the present invention can also serve as a driving force of another switching lever for switching a paper conveyance path between a plurality of levels.

Since the printer of the present invention has a paper feed roller and a trailing roller for clamping and conveying paper, a friction switching mechanism for changing the paper clamping pressure between the two rollers, a paper feed motor for driving the paper feed roller, a clutch mechanism for transmitting a driving force of the paper feed motor to the friction switching mechanism, a ribbon feed motor for driving an ink ribbon inserted between a printing head and a platen, and a drive force transmission mechanism for transmitting an inverse driving force of the ribbon feed motor to the clutch mechanism, this printer can change the pressure between the trailing rollers and paper feed rollers while preventing human misoperations without requiring motors exclusively for changing said pressure.

BRIEF DESCRIPTION OF THE DRAWINGS

These and other features, aspects and advantages of the present invention will become better understood with reference to the following description, appended claims and accompanying drawings, wherein:

FIG. 15, (A) and (B), are cross-sectional views illustrating an attachment structure of a cut sheet feeder and rear tractor selectively installed at the rear of the printer.

DETAILED DESCRIPTION OF THE INVENTION

An embodiment of the present invention will be explained with reference to the drawings.

Figure 1:
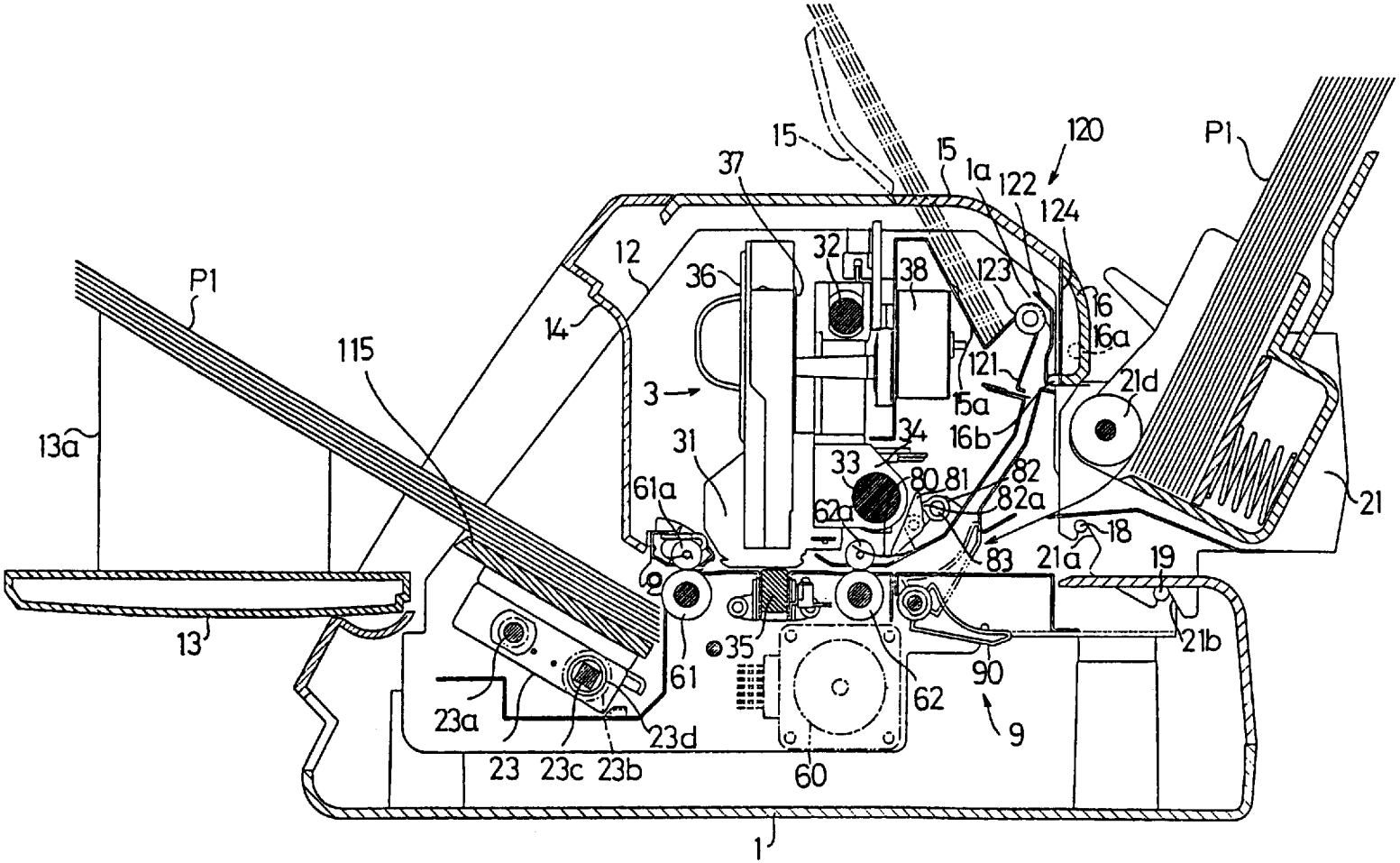
FIG. 1 is a cross-sectional drawing showing a first usage mode of the present invention.

FIGS. 1 through 4 show various states of use of a printer. First, within an outer case 1 (FIG. 1), a right-side plate 11 (FIG. 5) and a left-side plate 12 (FIG. 7) are positioned facing each other and supported at their lower faces in close proximity to both side faces of the outer case. In the outer case 1 (FIG. 1), an openable/closable front cover 13 is provided at a front face thereof (left side of FIG. 1), an openable/closable partition cover 14 in the interior thereof, an openable/closable upper cover 15 in the upper face thereof, a rotatable switching cover 16 adjacent to the upper cover 15, and a detachable rear cover 17 at the rear face (right side in FIGS. 3 and 4) thereof. At the inner faces of the left and right plates 11 and 12 (FIGS. 5 and 7) protrude opposable guide pins 18 and 19 (FIG. 1).

Figure 2:
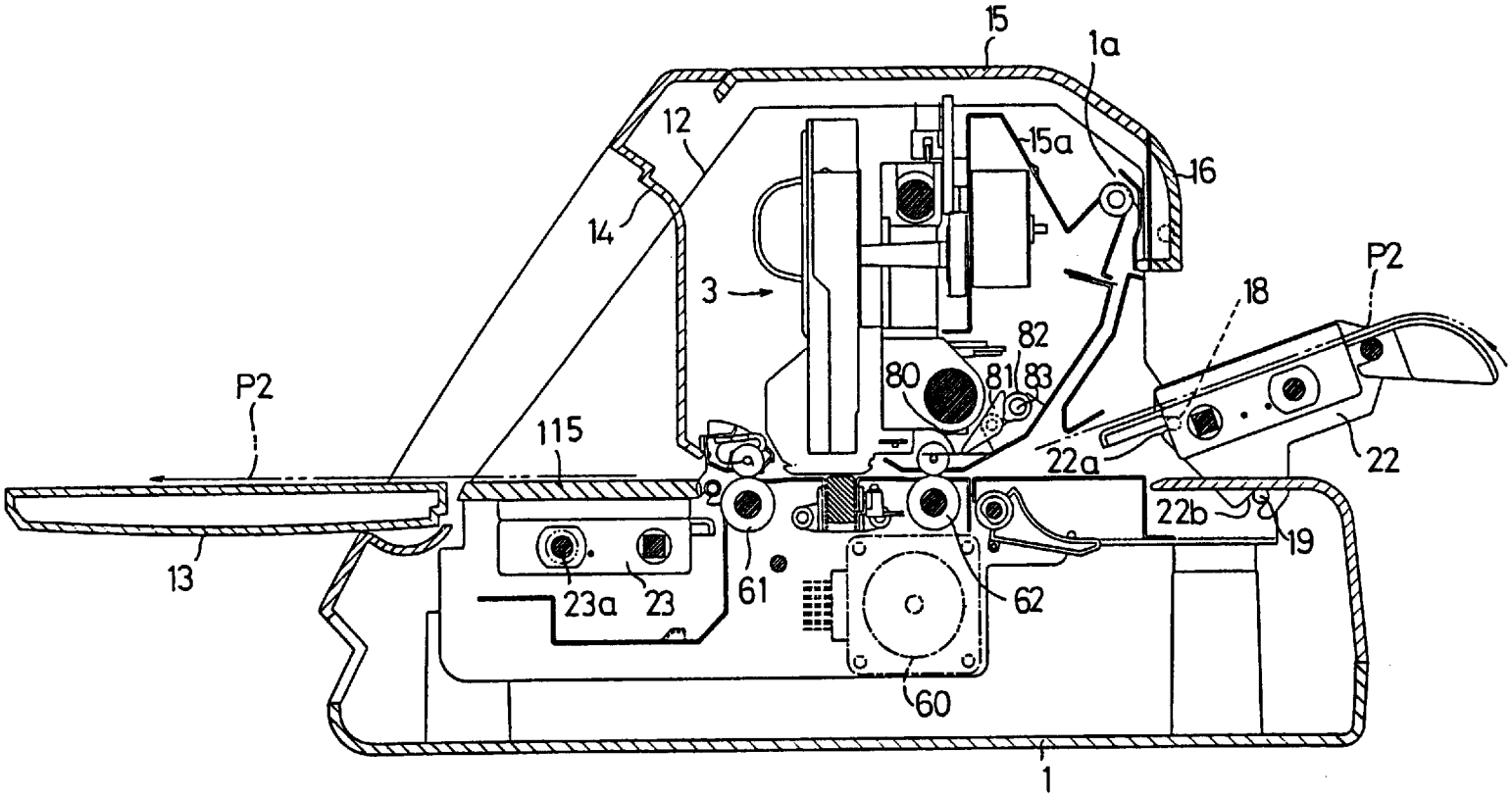
FIG. 2 is a cross-sectional drawing showing a second usage mode of the present invention.
Figure 3:
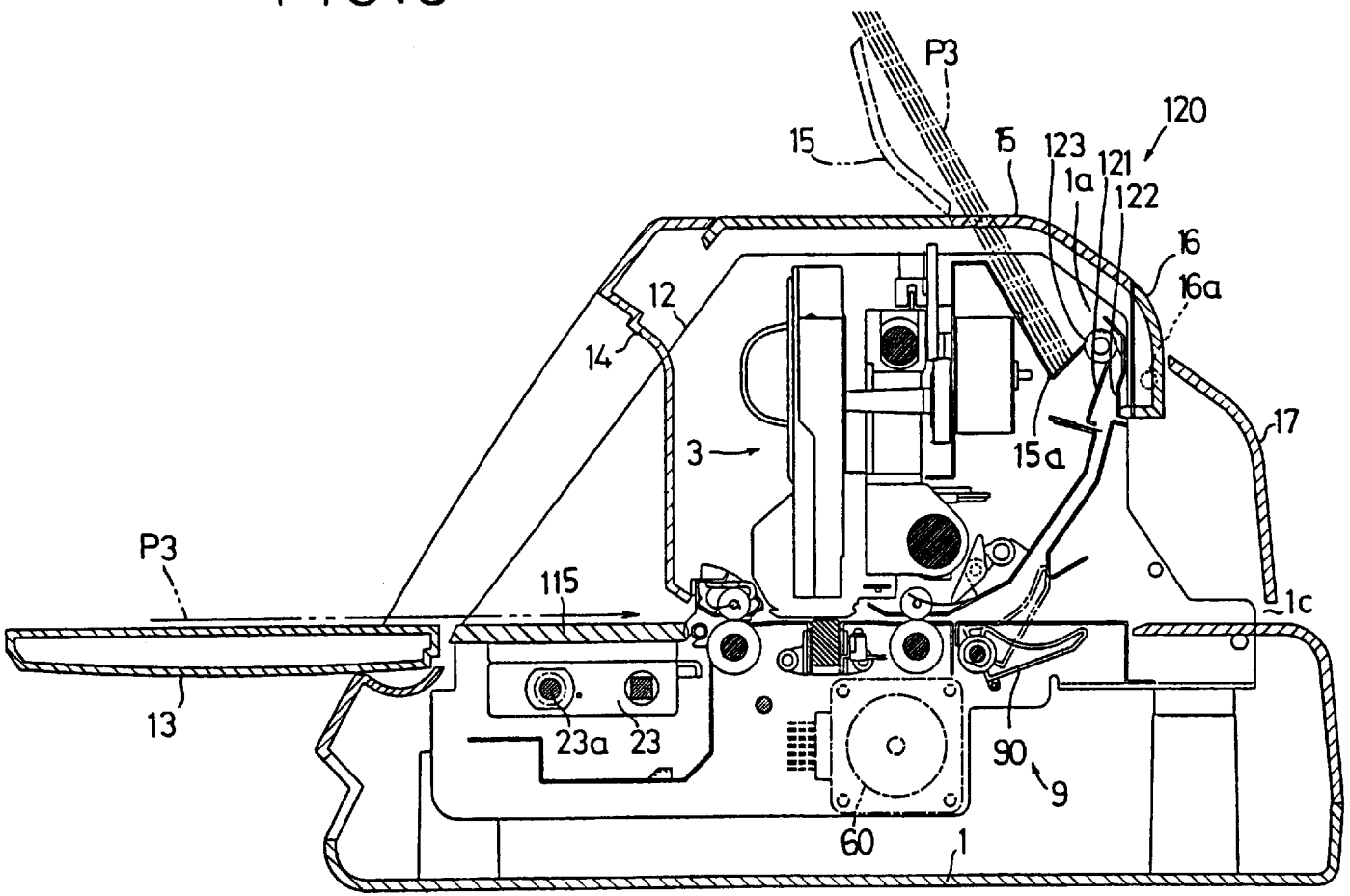
FIG. 3 is a cross-sectional drawing showing a third usage mode of the present invention.
Figure 4:
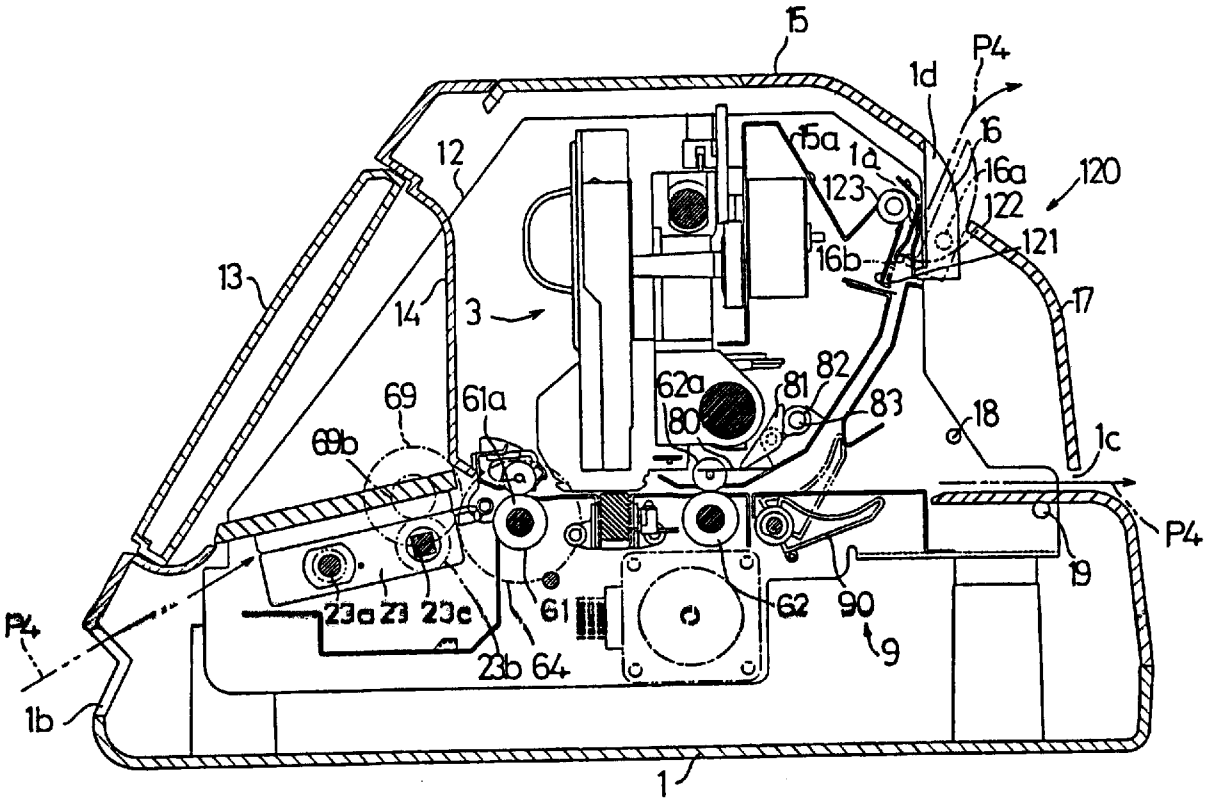
FIG. 4 is a cross-sectional drawing showing a fourth usage mode of the present invention.

This printer can be used by removing the rear cover 17 from the state of FIGS. 3 and 4 and attaching a cut sheet feeder 21 as shown in FIG. 1 or a continuous sheet tractor feeder 22 as shown in FIG. 2 to the guide pins 18 and 19. In the cut sheet feeder 21 or the continuous sheet tractor feeder 22 are provided guide grooves 21*a* and 21*b* or 22*a* and 22*b*, respectively. A front tractor 23 which can pivot on a shaft 23*a* is provided.

Figure 6:
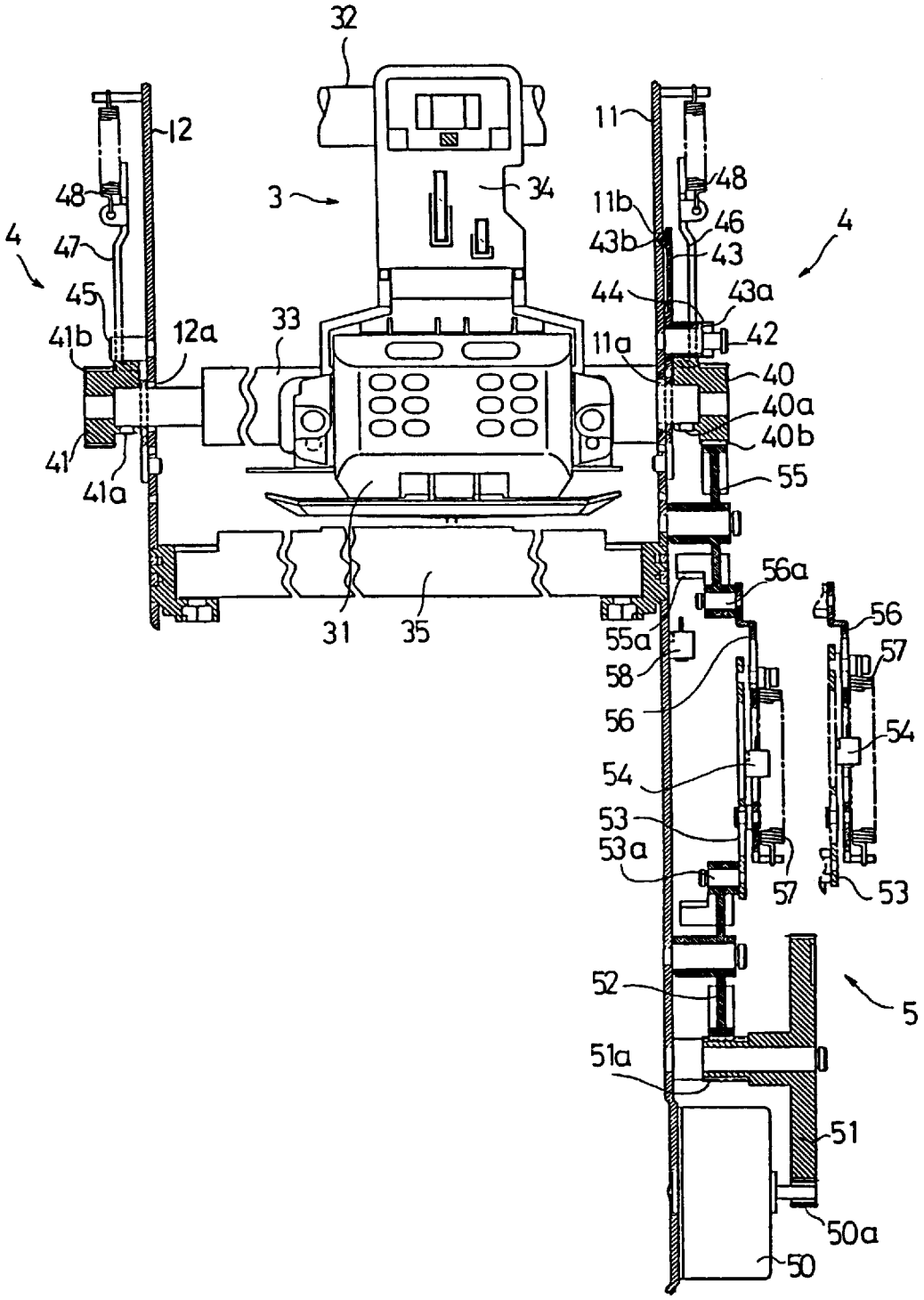
FIG. 6 is a cross-sectional view expanding and illustrating both of the apparatuses of FIG. 5.

Next, explanation of a printing apparatus 3 will be given. In FIG. 1 and FIG. 6, a printing head 31 is mounted on a carrier 34 which moves in the left and right directions of the printer by means of upper and lower guide shafts 32 and 33, both ends of which are supported by the side plates 11 and 12. The lower guide shaft 33 penetrates the carriage 34 and the upper guide shaft 32 guides the vertical movement of the carriage 34. A platen 35 is provided facing the printing head 31, both ends thereof being supported by the side plates 11 and 12. As is shown in FIG. 1, a ribbon cassette 36 is fixedly provided by a ribbon cassette support frame 37 in a position which does not interfere with the movement of the printing head 31, and is such that the ribbon travels in one direction by means of a positive rotation drive of a ribbon feed motor 38 positioned in the rear. An ink ribbon, not shown in the diagram, is installed in the ribbon cassette 36, this ribbon being wound around the outside of the movement range of the printing head 31. The carriage 34 is movement driven in a perpendicular direction to the surface of the paper by a carriage motor 39 shown in FIG. 12. Note that the ribbon cassette support frame 37 is fixedly mounted between the side plates 11 and 12.

Figure 5:
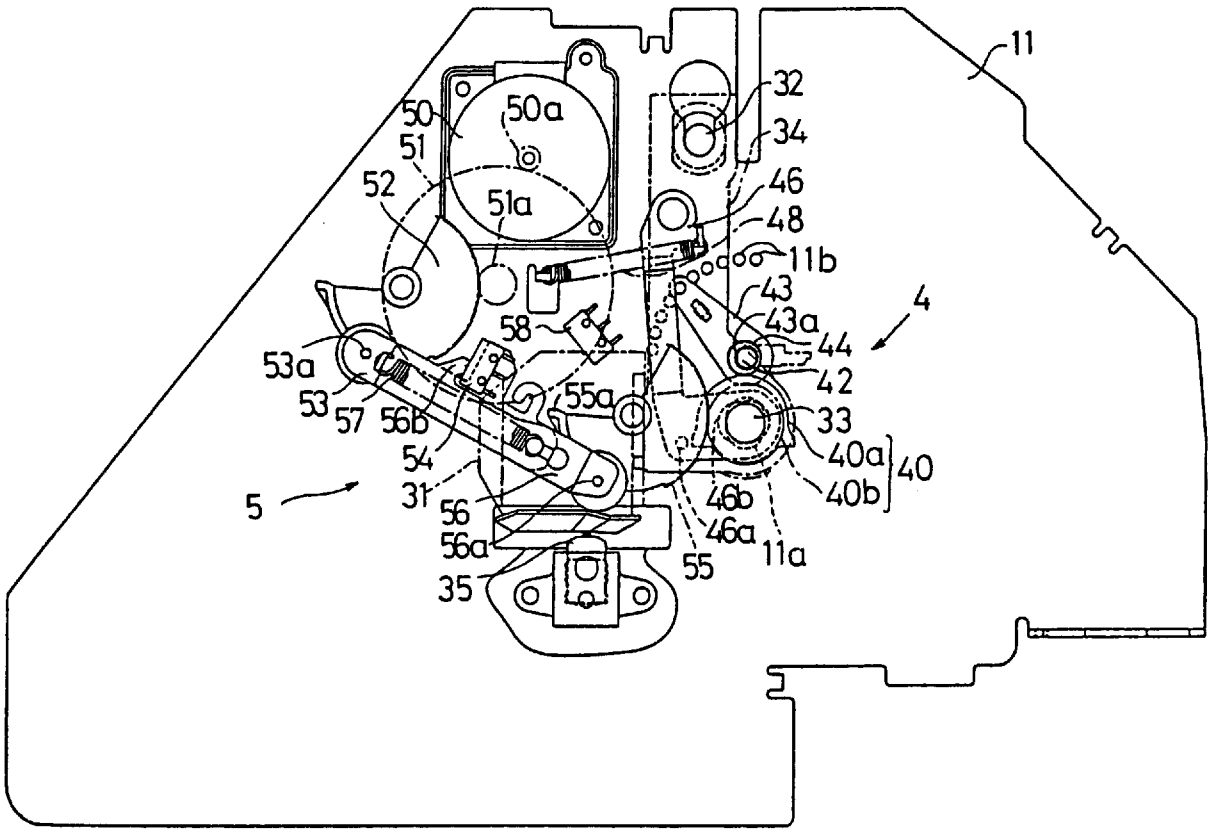
FIG. 5 is a right-hand side view illustrating an adjusting apparatus for adjusting the parallelism of a printing head with a platen and a gap adjusting apparatus for adjusting the gap between the two.
Figure 7:
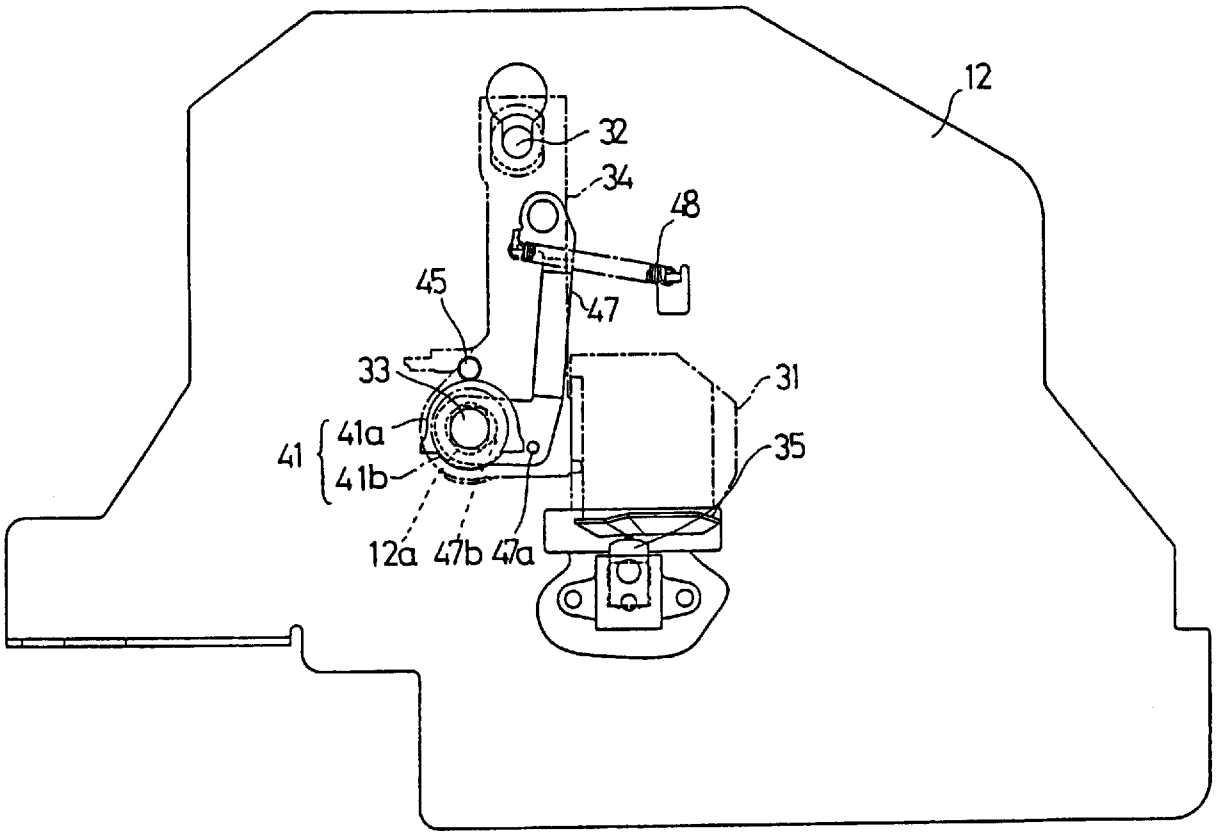
FIG. 7 is a left-hand side view illustrating the gap adjusting apparatus between the printing head and the platen.

Next, the printing head 31 is advanced towards the platen 35 without its position facing the platen 35 changing; explanation of the parallelism of the printing head 31 and the mechanism for adjusting the gap between the platen 35 and the printing head 31 will be given with reference to FIG. 5 through FIG. 7. FIG. 5 is a diagram of the outside (right hand side) of the right side plate 11 and FIG. 7 is a diagram of the outside (left hand side) of the left side plate 12, while FIG. 6 shows a cross-section of both side plates and an expanded view of the parallelism adjusting mechanism 4.

Firstly, explanation will be given of the parallelism adjusting mechanism 4. As previously explained, both ends of the guide shaft 33 penetrate and are supported by the left and right side plates 11 and 12 as shown in FIG. 6, the penetration holes thereof are extended in the vertical direction, i.e., there are slits 11*a* and 12*a* which serve as guide means for guiding the guide shaft 33 in the direction in which the printing head 31 approaches and separates from the platen 35. Consequently, eccentric bushes 40 and 41 having eccentric cam faces 40*a* and 41*a*, respectively, are fixed to the protruding ends of the guide shaft 33 which protrude from the side plates 11 and 12. Toothed portions 40*b* and 41*b* are provided in the eccentric bushes 40 and 41, respectively.

A pin 42 is provided protruding from the side plate 11 as the positioning member of the eccentric cam face 40*a*, and this pin contacts the eccentric cam face 40*a*. A boss portion 43*a* having an eccentric outer circumferential surface is interfitted with this pin 42, and a metal pipe 44 is rotatably interfitted with this boss portion. The pipe 44 is such that it connects to the eccentric cam face 40*a*. A parallelism adjusting lever 43 is integrally provided in the boss portion 43*a*, this lever being rockable around the pin 42. A clicking protrusion 43*b* provided at the tip of the parallelism adjusting lever 43 is such that it selectively engages with a plurality of clicking holes 11*b*, which are arranged in a circle around the pin 42 in the side plate 11 (see FIG. 5).

A pin 45 is provided protruding from the side plate 12 as the positioning member of the eccentric cam face 41*a*, and this pin contacts the eccentric cam face 41*a*. In order for the eccentric cam faces 40*a* and 41*a* to be able to continuously contact the pipe 44 or the pin 45, L-shaped levers 46 and 47 rockably supported by central pins 46*a* and 47*a* are used. Slits 46*b* (FIG. 5) and 47*b* (FIG. 7) which are long in the left and right directions are provided at the lower end portions of both levers 46 and 47, and both end portions of the guide shaft 33 penetrate both of these slits. A tension spring 48 is attached to the upper end portions of both levers 46 and 47, and this spring imparts a force to bring the pipe 44 or the pin 45 into flexible contact with the eccentric cam faces 40*a* and 41*a* via the guide shaft 33.

Since the parallelism adjusting mechanism 4 is constructed in this way, a problem with the parallelism of the printing head 31 and the platen 35 can be corrected by changing the engaging position of the clicking protrusion 43*b* and the clicking holes 11*b*. Since the parallelism adjusting lever 43 thereby rotates, the boss portion 43*a* also rotates about the pin 42 and, therefore, the contact position of the pipe 44 and the eccentric cam face 40*a* moves up and down slightly. In other words, when the small diameter portion of the boss portion 43*a* is in a position contacting the eccentric cam face 40*a*, this contact position rises slightly and consequently the right end portion of the guide shaft 33 rises. Also, conversely, when the large diameter portion of the boss portion 43*a* is in a position contacting the eccentric cam face 40*a*, this contact position drops slightly and, consequently, the right end portion of the guide shaft 33 drops. In this way, the left end portion of the guide shaft 33 serves as a reference, and the right end portion of the guide shaft 33 rises and drops. This rise or drop is transmitted to the printing head 31 via the carriage 34, and, thus, the parallelism with the platen 35 can be adjusted. This movement of the guide shaft 33 is restricted to the slit 11*a* of the side plate 11, therefore the position facing the platen 35 cannot be changed.

Next, explanation will be given of the adjusting apparatus 5 for adjusting the gap between the printing head 31 and the platen 35. As shown in FIG. 5 and FIG. 6, a gap adjusting motor 50 is fixed to the side plate 11. A gear 51 engages with a pinion 50*a* fixed to the drive shaft of this motor 50. A gear 52 having a notched portion engages with the pinion 51*a* of this gear. A first lever 53 is connected to this gear 52 via a pin 53*a*. A microswitch 54 is fixed to the top of this lever. Meanwhile, a gear 55 having a notched portion is engaged with the toothed portion 40*b* of the bush 40. A lever 56 is connected with this gear 55 via a pin 56*a*. The first lever 53 and second lever 56 have ends opposite their portions connecting with the gears 52 and 55, respectively, via the pins 53*a* and 56*a* which are in an overlapping state. A tension spring 57 is attached between levers 53 and 56. Also, a detection plate 56*b* is provided on the lever 56 to push and release an operating protrusion on the microswitch 54 and thereby turn the switch on and off. In addition, the angle of the notched portion of the gear 55 serves as a detection plate 55*a* to push and release an operating protrusion on an initial switch 58 and, thereby, turn the switch on and off. Normally, the operating protrusion of the microswitch 54 is pushed against the detection plate 56*b* by the spring 57 and therefore the switch is in an on state and the operating protrusion of the initial switch 58 is not pushed against the detection plate 55*a* and therefore the switch is in an off state.

One can adjust the gap between the printing head 31 and the platen 35 by driving the gap adjusting motor 50 and rotating the pinion 50*a* clockwise. This rotation is then transmitted to the gear 52 via the gear 51 and the lever 53 is moved in the leftward direction, i.e., towards the back of the printer. This movement is transmitted to the lever 56 via the microswitch 54 and the detection plate 56*b*, and also via the gear 55 which has rotated in the clockwise direction of FIG. 5 resulting in bush 40 being rotated in the anti-clockwise direction. Since by means of this rotation the small diameter portion of the eccentric cam face 40*a* is in a state where it contacts the pipe 44, the guide shaft 33 moves in the direction in which the platen 35 separates, i.e., rises. By means of this clockwise rotation of the gear 55, the detection plate 55*a* approaches the initial switch 58 and finally it pushes the operating protrusion, switching the switch on. In this way the rise position (initial position) of the printing head 31 is detected.

If the gap adjusting motor 50 is driven in reverse and drives the pinion 50*a* in the anti-clockwise direction, this rotation is transmitted to the gear 52 via the gear 51 and moves the lever 53 in the rightward direction, i.e., towards the front of the printer. Since the lever 56 moves in the rightward direction in accordance with the lever 53, the gear 55 rotates in the anti-clockwise direction and simultaneously with the detection plate 55*a* releasing the pressure on the switch 58 and the switch returning to an off state, the bush 40 is rotated in the clockwise direction. By means of this rotation, the large diameter portion of the eccentric cam face 40*a* reaches a state where it contacts the pipe 44 and the guide shaft 33 falls in the direction towards the platen 35. Finally, the printing head 31 contacts the recording paper and progresses to a position where it can fall no further. If the motor 50 continues its rotation further in the same direction, the lever 56 cannot follow the movement of the lever 53 in the fastest rightward (forward) direction. Consequently, the spring 57 is elongated and only the lever 53 moves. Further, since the microswitch 54 also moves in the rightward (forward) direction, the detection plate 56*b* cannot push the operating protrusion of the microswitch 54, and the switch is off. In this manner the advance position of the printing head 31 is detected.

The gap adjusting motor 50 is again driven in reverse and in the same manner as described above the lever 53 is moved in the leftward, i.e., backward, direction. At the commencement of this movement, the spring compresses only the elongated amount and in that interval the lever 56 does not follow the lever 53. Therefore, the pushing plate 56*b* again receives the force of the spring 57 and pushes the operating protrusion of the switch 54, and the switch returns to the on state. From this position the printing head 31 retreats only by the amount of the preferred gap. Namely, a drive signal corresponding to this movement amount, for example a pulse signal of a corresponding number, is supplied to the gap adjusting motor 50, whereupon the motor pinion 50*a* rotates in the clockwise direction only by a predetermined amount. The printing head 31 retreats by this predetermined amount in the same manner as described above, and thereby an optimum gap can be set with the platen 35.

Figure 9:
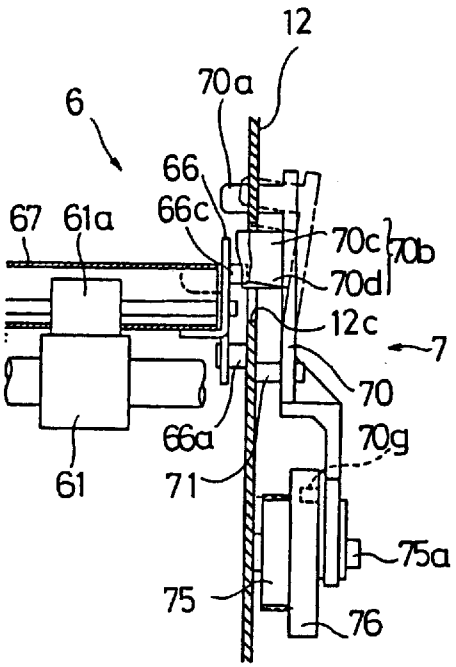
FIG. 9 is a cross-sectional view illustrating a roller friction switching apparatus.
Figure 8:
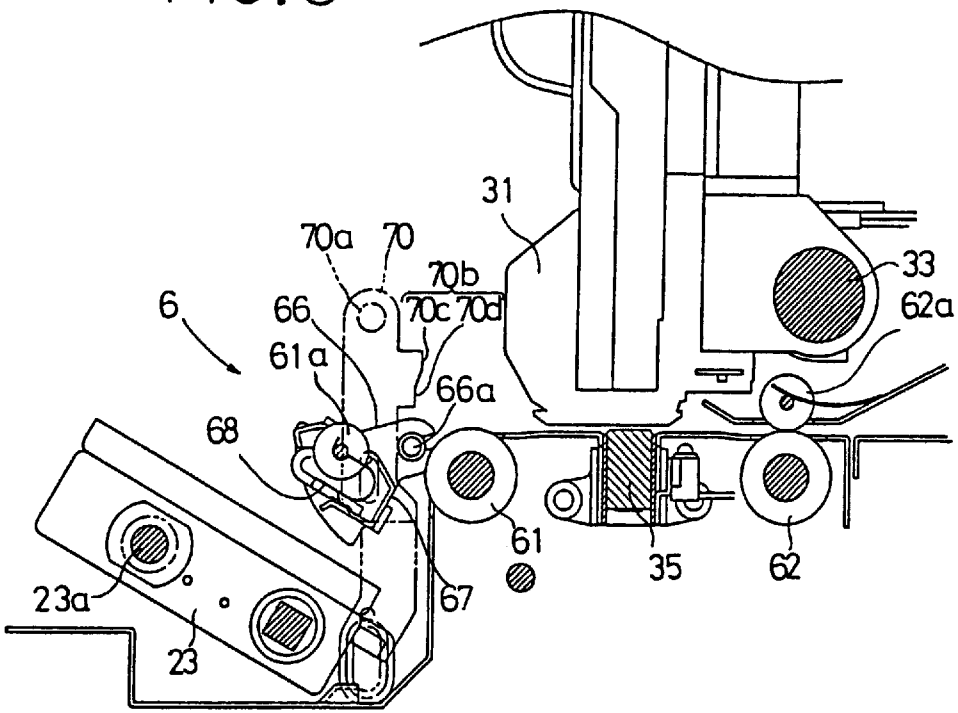
FIG. 8 is a cross-sectional view illustrating a paper feed apparatus.
Figure 12:
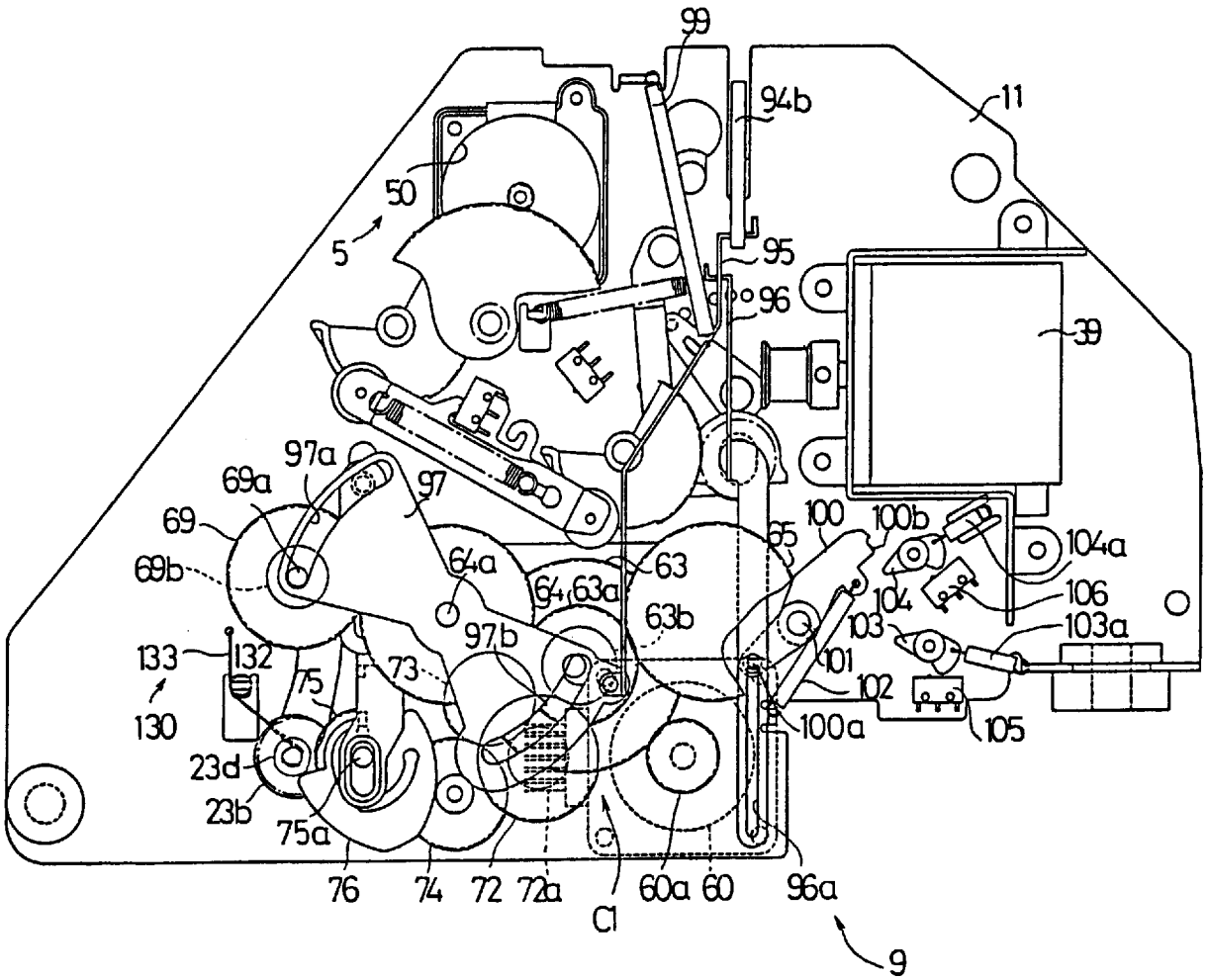
FIG. 12 is a right-hand side view illustrating a switching lever apparatus.

Next, explanation will be given of a paper feed apparatus 6 (see FIGS. 8 and 9). As shown in FIG. 1, at the front and back of the platen 35 are arranged paper feed rollers 61 and 62. As shown in FIG. 12, the paper feed rollers 61 and 62 is supplied a sequential rotation drive force which is transmitted by a gear 63 from the motor pinion 60*a* of a motor 60 to a gear 64 and to a gear 65 from a pinion 63*a* connected to gear 63. Thus, the paper feed rollers 61 and 62 are driven as shown in FIG. 1. In FIG. 1, trailing rollers 61*a* and 62*a*, which are provided on the printing head 31 side, flexibly contact the paper feed rollers 61 and 62. Thus, the paper feed rollers 61 and 62 and trailing rollers 61*a* and 62*a* perform feeding of the paper in their respective pairs.

Figure 10:
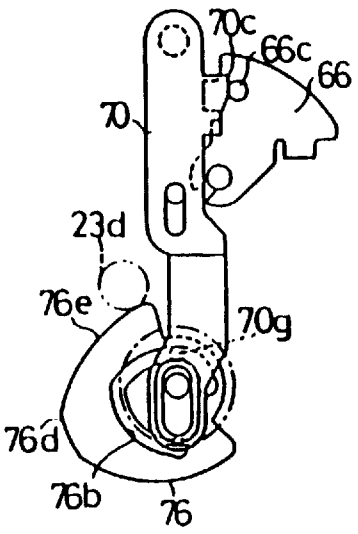
FIG. 10, (A), (B), (C), (D), (E) and (F), are front views showing roller friction switching in stages.
Figure 10:
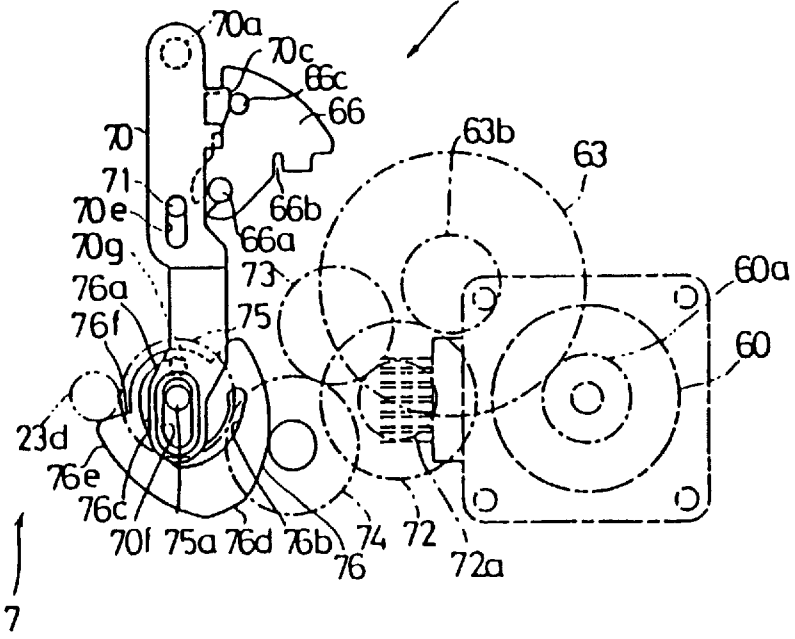
Figure 10:
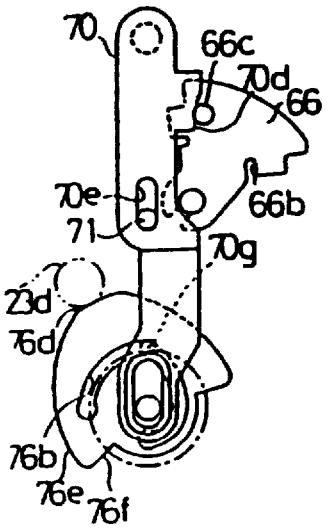
Figure 10:
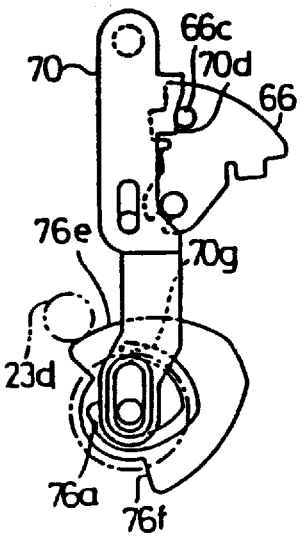
Figure 10:
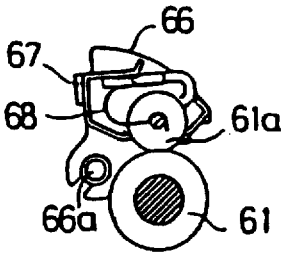
Figure 10:
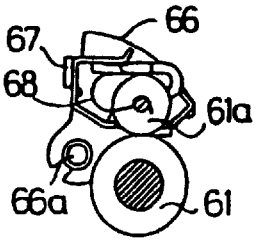

Also, at the side approaching the front cover 13, i.e., at the attachment/detachment side of the printing head 31, are provided the paper feed roller 61 and the trailing roller 61*a* for holding and conveying the paper. If the trailing roller 61*a* is provided in a position approaching the printing head 31 due to the necessity for miniaturization for example, the trailing roller 61*a* may hinder replacement of the printing head 31. Therefore, a mechanism is employed to move the trailing roller 61*a* to a position where it would not interfere with replacement of the printing head 31. To that end, the trailing roller 61*a* is switchable between a paper transport position where it faces and flexibly contacts the paper feed roller 61 as shown in FIG. 1 and a non-paper feed position where it does not flexibly contact the paper feed roller 61 as shown in FIG. 8. This switching mechanism, as shown in FIGS. 8 through 10, in both inner faces of the right and left side plates 11 and 12 is supported by switching levers 66, which are rockable by means of a pin 66*a*. The space between both switching levers is linked by a plate 67. As shown in FIG. 10, a U-shaped long groove 66*b* is formed in the switching levers 66. The axle of the trailing roller 61*a* is interfitted with and rotatably supported by this long groove 66*b*. One end portion of a U-shaped spring is attached to the trailing roller 61*a*, and when paper feeding, this trailing roller is flexibly contactable with the paper feed roller 61. Although the rocking movement of the switching lever 66 is performed by hand, this switching lever is rockably supported so that it can change position from a paper feed position where the trailing roller 61*a* faces and flexibly contacts the paper feed roller 61 to a non-paper feed position, i.e., a position where the trailing roller crosses the paper conveyance path and is opposite the side at which the printing head 31 is disposed with the paper conveyance path serving as a boundary.

Then, at times when the necessity to change the printing head 31 arises, the partition cover 14 shown in FIG. 1 is opened, a locking means is released and the switching lever 66 is rotated by hand by means of a sliding plate 70 which will be explained later, and the trailing roller 61*a* is moved to the non-paper feed position (the solid line position in FIG. 8).

Figure 11:
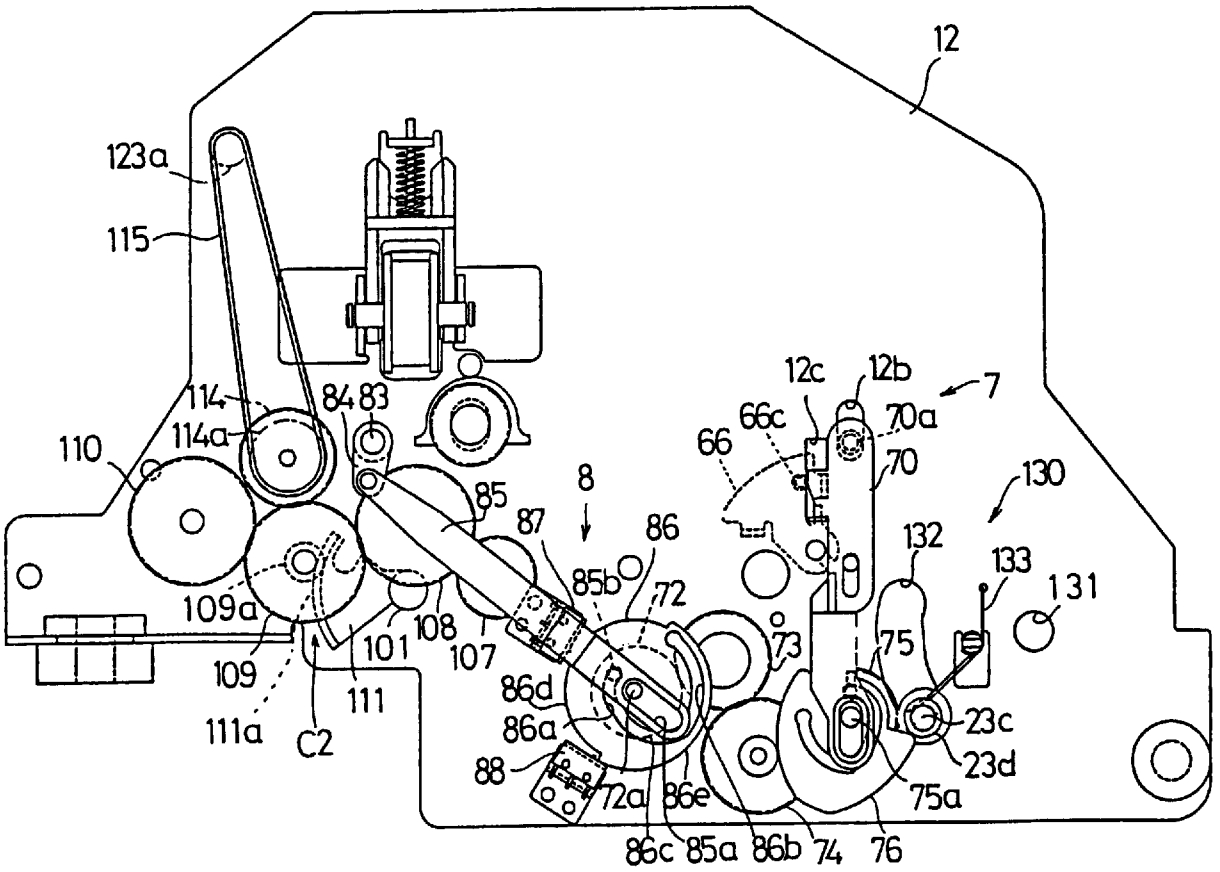
FIG. 11 is a left-hand side view illustrating the roller friction switching apparatus.

Next, explanation will be given of a roller friction switching apparatus 7 (see FIG. 9). The flexible contact force of the trailing roller 61*a* against the paper transport roller 61 is preferably large for cut sheets and small for continuous paper, among the papers using by the printer. The flexible contact force (roller friction) of the trailing roller 61*a* against the paper transport roller 61 is such that one of two differing strengths of flexible contact forces can be selected at each of the positions The structure at the left side plate 12, as shown in FIG. 9 and FIG. 11, will now be explained. From the switching lever 66 protrudes a positioning pin 66*c* facing the right and left side plates 11 and 12. The sliding plate 70 is movably provided in a vertical direction on the outside of the left side plate 12. At the upper end portion of the sliding plate 70, an operating pin 70*a* penetrates and protrudes from the vertical slit 12*b* provided in the left side plate 12. The upper end portion of the sliding plate 70 can be bent by pushing in the end of the operating pin which protrudes from the side plate. In the vicinity of the operating pin 70*a* is protrudingly provided a cam plate 70*b* which penetrates the up and down direction slit 12*c* provided in the left side plate 12 and protrudes. The cam plate 70*b*, as shown in FIG. 8, has formed as part thereof two stages of cam faces 70*c* and 70*d* of an advance position and retreat position on a face which is opposedly contactable with the positioning pin 66*c* when in an engaging portion with the switching lever 66. When the length of the cam face 70*d* from the operating pin 70*a* is shorter than that of the cam face 70*c*, in a state where the operating pin 70*a* is pushed and the sliding plate 70 is bent, then the end faces of both cam faces retreat to a position substantially equal to that of the inner face of the side plate. In this state the switching lever 66 is rockable by hand operation.

In the paper feed position where the trailing roller 61*a* displaces to the paper feed position, the means for rocking the trailing roller consists of a cam side 70*b* provided in the sliding plate 70 and a positioning pin 66*c* provided in the switching lever 66. Vertical slits 70*e* and 70*f* are provided in the central portion and lower end portion of the sliding plate 70, respectively. A fixed axle 71 which protrudes from the side plates 11 and 12 penetrates the central portion slit 70*e*. As shown in FIG. 10, in the gear 63, which is one part of the transmission system from the paper feed motor, is provided a pinion 63*b*. A gear 72 engages with this pinion 63*b*. Gears 73, 74 and 75 sequentially engage with a pinion 72*a* thereof, and a central axle 75*a* of a gear 75 penetrates the lower end portion slit 70*f* of the sliding plate 70. The gear 75 is integrally provided with an eccentric cam 76. At the surface of the eccentric cam 76, a cam groove is provided. This cam groove, as shown in FIG. 10, connects a small arc cam groove 76*a* with a central angle of 900 to the right and a large arc cam groove 76*b* with an initial central angle of 90° from a position separated by a central angle of 90°, and connects them with an inclined cam groove 76*c* having a central angle of 90°. A trailing pin 70*g* which protrudes from the sliding plate 70 is engaged with these cam grooves 76*a*, 76*b* and 76*c*.

When selecting the roller friction, a clutch mechanism C1 to be described later which connects/disconnects the pinion 63*b* and gear 72 in the transmission system to/from the paper feed motor 60 is connected. Therefore, the gear 75 is rotated as shown in FIG. 10. The eccentric cam 76 and the cam grooves 76*a* to 76*c* thereof also rotate together with the rotation of the gear 75, from the position where the trailing pin 70*g* engages the end portion of the small diameter cam groove 76*a* of FIG. 10(A) to the position where it engages the boundary of the small diameter cam groove 76*a* and the inclined cam groove 76*c* of FIG. 10(B). The sliding plate 70 stops at the drop position without being driven upward. Since the sliding plate 70 stops at the drop position, the positioning pin 66*c* of the switching lever 66 contacts the cam face 70*c* at the advance position of the sliding plate 70, and the trailing roller 61*a* which is supported by the switching lever 66 receives the spring force of the spring 68 at the advance position. Thus, trailing roller 61*a* flexibly contacts the paper feed roller 61. In other words, in this state the roller friction is large, as shown in FIG. 10(E).

When the rotation amount transmitted from the paper feed motor 60 to the gear 75 is large, the trailing pin 70*g* passes the cam groove 76*a* and the inclined cam groove 76*c*, and slides the inside of the cam groove from a position engaging the boundary of the inclined cam groove 76*c* of FIG. 10(C) and the large diameter cam shaft 76*b* to a position engaging the end portion of the large diameter cam shaft 76*b* of FIG. 10(D). Thus, the paper feed motor 60 via the trailing pin 70*a* drives the sliding plate 70 upwards, moving it to a raised position. In the raised position of the sliding plate 70, the positioning pin 66*c* of the switching lever 66 contacts the cam face 70*d* at the retreat position of the sliding plate 70. Thus, the trailing roller 61*a* is supported by the switching lever 66 which receives the spring force of the spring 68 at the retreat position and flexibly contacts the paper feed roller 61. In other words, in this state the roller friction is small as shown in FIG. 10(F).

Consequently, in the case of FIG. 10(A) and (B) where the roller friction is set large, either the cut sheet feeder 21 is used (shown in FIG. 1) or paper is provided by manual feeding (shown in FIG. 3), respectively. In the case of FIG. 10(C) and (D), the roller friction is set small so that either the front tractor 23 is used (shown in FIG. 4) or the continuous sheet tractor feeder is used (shown in FIG. 2), respectively.

Although selection of friction relating to the trailing roller 61*a* at the front of FIG. 1 is by the roller friction switching apparatus 7 already described, a roller friction switching apparatus 8 relating to the trailing roller 62*a* at the rear is also provided. As shown in FIG. 1, the trailing roller 62*a* sandwiches the paper conveyance path, and faces the paper feed roller 62, and flexibly contacts the roller 62 by means of the spring force of a plate spring 80. The friction between the trailing roller 62*a* and the paper feed roller 62 can be modified by adjusting the spring force of the plate spring 80. At the upper portion of the plate spring 80, a rocking plate 81 is provided slidable around a central portion, and the lower portion of the rocking plate 81 abuts the plate spring 80. At the upper end of the rocking plate 81, a cam 82 having a protrusion 82*a* is provided, the upper end portion of the rocking plate 81 being compressible by means of the protrusion 82*a*. An axle 83 of the cam 82 protrudes to the exterior from the left side plate 12 and as shown in FIG. 11 a lever 84 is fixed to the protruding end thereof. One end portion of a connecting lever 85 is freely rotatably fixed to the tip portion of the lever 84. The other end portion of the connecting lever 85 consists of a slit 85*a* which is long in the longitudinal direction. The axle of the gear 72 previously described has a protruding axle 72*a* which protrudes to the exterior from the left side plate 12 and penetrates the slit 85*a*.

As shown in FIG. 11, a cam 86 is provided integral with the gear 72 which is formed integrally with the protruding axle 72*a*. A cam groove is formed in the surface of this cam 86. This cam groove, centering around the protruding axle 72*a*, connects a small arc cam groove 86*a* with a central angle of 90° to the left and a large arc cam groove 86*b* with an initial central angle of 90° from a position separated by a central angle of 90°, and connects them with an inclined cam groove 86*c* having a central angle of 90°. A trailing pin 85*b* provided perpendicular to the connecting lever 85 is engaged with these cam grooves 86*a*, 86*b* and 86*c*. Also, the cam face of the outer surface of the cam 86 comprises a small diameter cam face 86*d* and a large diameter cam face 86*e*, the central angle of both cam faces being 180°. Microswitches 87 and 88 which can each be switched on and off by the cam surfaces are fixed to the connecting lever 85 and the left side plate 12 with an opening angle of 90° about the central axle 72*a*.

In the state of FIG. 11, the trailing pin 85*b* engages with the end portion of the small diameter cam groove 86*a*. Therefore, the connecting lever 85 is in the drop position and the lever 84 is in a state rotating in the anti-clockwise direction. This rotation is transmitted to the cam 82 via the axle 83. The rocking plate 81 is pushed by the protrusion 82*a* as shown in FIG. 1 and rocks in the anti-clockwise direction. The plate spring 80 at the lower end of the rocking plate is pushed and bent strongly, and, as a result, the friction between the trailing roller 62*a* and the paper feed roller 62 is large. At this position, since the operating protrusions of the microswitches 87 and 88 both face the small diameter cam face 86*d*, both switches are off. This is a first detection state reached by means of the two microswitches 87 and 88, and is the same position in which the trailing pin 70*g* described previously engages with the end portion of the small diameter cam groove 76*a* in correspondence with paper feeding by the cut sheet feeder 21 shown in FIG. 10(A).

When the rotation from the paper feed motor 60 is transmitted, the gear 72 is rotated 90°, but the position of the connecting lever 85 does not change because the trailing pin 85*b* is still positioned at the cam groove 86*a*. The friction is still large, but the operating protrusion of the microswitch 88 is in a state where it is being pushed by the large diameter cam face 86*e*. Although the microswitch 87 is in the off state, the microswitch 88 is on. This is the second detection state reached by means of the two microswitches 87 and 88, and is the same position in which the trailing pin 70*g*, described previously, engages with the boundary of the small diameter cam groove 76*a* and the inclined cam groove 76*c* in correspondence with paper feeding by hand as shown in FIG. 10(B).

When the gear 72 is rotated another 90°, the connecting lever 85 is in a raised position and can move in a horizontal direction because the trailing pin 85*b* is positioned at the large diameter cam groove 86*b*. The lever 84 rotates in the clockwise direction which is transmitted to the cam 82 via the axle 83, and the cam 82 rotates in the clockwise direction, whereby the protrusion 82*a* is released from the position where it pushes the rocking plate 81 as shown in FIG. 4. As a result, the rocking plate 81 no longer pushes the plate spring 80 at its lower end, the pressure is weakened, and the friction between the trailing roller 62*a* and the paper feed roller 62 becomes small.

Also, at this position the operating protrusion of the microswitch 87 reaches a state where it is pushed inward by the large diameter cam face 86*e*, and, thus, is switched on. Note that the microswitch 88 is still on. This is the third detection state reached by means of the two microswitches 87 and 88, and is the same position in which the trailing pin 70*g* described previously engages with the boundary of the inclined cam groove 76*c* and the large diameter cam groove 76*b* in correspondence with paper feeding by the front tractor as shown in FIG. 10(C).

When the gear 72 is rotated another 90°, the raised position of the connecting lever 85 does not change because the trailing pin 85*b* is still positioned at the cam groove 86*b*. Although the friction is small in this state, the operating protrusion of the microswitch 88 passes the large diameter cam face 86*e* and reaches a state where it faces the small diameter cam face 86*d*. Consequently, although the microswitch 87 is still on, the microswitch 88 is switched off. This is the fourth detection state reached by means of the two micro switches and is the position in which the trailing pin 70*g* described previously engages with the end portion of the large diameter cam groove 76*b* in correspondence with paper feeding by the rear tractor as shown in FIG. 10(D).

In other words, by rotation of the gear 72 through 270°, the first through fourth detection states can be detected by the two microswitches 87 and 88.

The printer has four usage modes, the first of which, as shown in FIG. 1, is where, in a state wherein the front cover is opened, paper receiver 13*a* has a predetermined gap which is sufficient to support the recording paper placed in a standing state. In this state, the front tractor 23 rocks right and downward, a cut sheet P1 feed out from the cut sheet feeder 21 at the rear is in a usage state to be printed by the printing apparatus 3.

There are two paper ejection positions in the first usage mode, the first of which is a paper ejection position where the paper is discharged as is after printing at the front, i.e., the left, and stacked on a sliding table 115 and a paper receiver 13*a* as well as the front tractor 23. In the other paper ejection position, the top cover 15 is opened and the paper receiver 15*a* and upper paper ejection opening 1*a* is exposed. After printing on the cut sheet P1, the cut sheet P1 is passed through the printing apparatus 3 and is sensed by a sensor (not shown in the drawing). By means of the output of this sensor, as well as indicated by the motor 60 operating in reverse and by the state indicated by the switching lever apparatus 9, the cut sheet P1 is again conveyed toward the rear, and because it is then guided upwards, the paper exits from the first upper paper ejection opening 1*a* and is stacked on the upper cover 15 and the paper receiver 15*a*.

The second usage mode is a usage mode in which, as shown in FIG. 2, the front cover 13 is opened, the front tractor 23 is in a horizontal state, and the continuous paper P2 sent out from the rear tractor 22 is printed by the printing apparatus 3. The paper is ejected after printing toward the front and is stacked in a folding state on a base not shown in the diagram at the front of the front cover 13.

The third usage mode is a usage mode in which, as shown in FIG. 3, the front cover 13 is opened, the front tractor 23 is in a horizontal state, and cut sheets P3 are supplied by hand one by one from above the front cover 13 and printed by the printing apparatus 3. In this usage mode there are two paper ejection positions. In one paper ejection position, the cut sheet P1 passes through the printing apparatus 3 and is sensed by a sensor (not shown in the drawing). By means of the output of this sensor, the motor for feeding the paper then operates in reverse, and the cut sheet is conveyed in a return direction toward the front and is again returned to the front cover 13. In the other case, the top cover 15 is already open, the paper receiver 15*a* and upper paper ejection opening 1*a* are exposed, and the switching lever 9 is in the state shown by the chain line. This is a paper ejection position in which the cut sheets P3 are supplied one by one by hand from above the front cover 13, are conveyed toward the rear as is after printing by the printing apparatus 3, are further guided upward, and are stacked from the first paper ejection opening la onto the top cover 15 and the paper receiver 15*a*.

The fourth usage mode is a usage mode in which, as shown in FIG. 4, the front tractor 23 is in state where it has rocked to the right and downwards, and continuous paper P4 inserted from an insertion opening 1*b* provided under the front cover 13 is feed out by the front tractor 23 and printed by the printing apparatus 3. In this case there are two paper ejection positions, one of which is a paper ejection position in which the paper is ejected toward the rear after printing and ejected from the rear paper ejection opening 1*c* provided under the rear cover 17. In the other case, indicated by the position of the switching lever 90, as shown by the dotted line, the switching cover 16 is rocked as shown by the dotted line. This is facilitated by closing the first upper paper ejection opening 1*a* and opening a second upper paper ejection opening 1*d*. In this paper ejection position, the printed continuous paper P4 is guided upward after printing and exits the second paper ejection opening 1*d*.

Given the above, the paper conveyance path in each of the four usage modes will be explained in detail. As shown in FIG. 1 through FIG. 4, the paper conveyance path at the printing section, formed by the printing head 31, the platen 35 and the paper feed rollers 61 and 62 in front and behind the platen, is arranged horizontally, and there are four paths by which the paper printed here is ejected. Namely, the first path is a path for ejecting the paper toward the front, and can be used three ways; (1) in cases where the paper is printed using the cut sheet feeder 21 illustrated in FIG. 1; (2) in cases where it is printed using the continuous sheet tractor feeder 22 illustrated in FIG. 2; and (3) in cases where cut sheets are fed by hand as illustrated in FIG. 3 and the feed direction at the printing section is reversed to return the paper to the front after printing is complete.

The second path is a path for ejecting the paper to the first upper paper ejection opening 1*a*, and is used in two ways. First, in cases where the paper is printed using the cut sheet feeder 21 illustrated in FIG. 1, the feeding direction is reversed and the paper is conveyed toward the rear and further upward. The second way paper is ejected through opening 1*a* is in cases where the paper is printed by hand feeding as illustrated in FIG. 3.

The third path is a path for ejecting paper toward the second upper paper ejection opening 1*d*, and is used in cases where the paper is printed using the front tractor 23 as illustrated in FIG. 4.

The fourth path is a path for ejecting paper toward the rear paper ejection opening 1*c*, and is used in cases where the paper is printed using the front tractor 23 as illustrated in FIG. 4.

The first upper paper ejection opening 1*a*, second upper paper ejection opening 1*d* and rear paper ejection opening 1*c* are all positioned rearward of the printing section. Therefore, the paper conveyed rearward from the printing section is firstly switched upwards or rearward by the switching configuration of the switching lever apparatus 9. Subsequently, the paper moving upwards is switched either to the first upper paper ejection opening 1*a* or the second upper paper ejection opening 1*d* depending on whether the cover 16 is opened or closed and whether the second upper paper ejection opening 1*d* is opened.

A paper ejection switching apparatus 120 for the first upper paper ejection opening 1*a* and second upper paper ejection opening 1*d* will be explained with reference to FIG. 3 and FIG. 4. The first upper paper ejection opening 1*a* is a path formed between a guide plate 121 and a paper path switching lever 122. The switching lever 122 is rockably supported with the paper ejection roller 123 as the center about which it rocks. The paper ejection roller 123 is such that the rotation of the paper feed motor 60 is transmitted thereto. The paper receiver 15*a* is connected to the outside of the paper ejection roller 123. The switching cover 16 is rockably supported by the axle 16*a* and a guide plate 124 is fixed to the interior face thereof. Two protrusions 16*b* are provided in the switching cover 16 protruding toward the inside from the guide plate 124. Both of these protrusions 166 provided in the switching cover have a gap which is, at least, wider than the width of the paper. The tips of the protrusions 16*b* contact the lower end of the switching lever 122.

Since the paper ejection switching apparatus 120 has such a structure, when the switching cover 16 is closed as shown in FIG. 3, the paper passes through the path between the guide plate 121 and the switching lever 122 and is ejected from the first paper ejection opening 1*a*. However, when the switching cover 16 is opened by hand and is rotated from the state shown in FIG. 3 to the state indicated by the dotted line in FIG. 4, then the protrusions 16*b* protruding at both end portions of the switching lever 122 push the lower end of the switching lever 122 against the guide plate 121. This switching lever interconnectedly rocks around the paper ejection roller 123 as a center and the lower end thereof contacts the lower end of the guide plate 121. As a result, at the same time that the path to the first upper paper ejection opening 1*a* is closed, the switching lever 122 and the guide plate 124 separate and the path to the second upper paper ejection opening 1*d* is opened, so that the paper can be ejected from the second upper paper ejection opening. When the switching cover 16 is closed, the switching lever 122 returns to its original position by means of spring force, the first upper paper ejection opening 1*a* opens, and paper is again ejected from the first upper paper ejection opening.

Next, the switching lever apparatus 9 will be explained with reference to FIGS. 11 through 14. A switching lever 90 is switchable through three stages, these being a lower stage position shown in FIG. 14(A), a middle stage position shown in FIG. 14(B), and a higher stage position shown in FIG. 14(C). Driving of the switching lever 90 is transmitted from the ribbon feed motor 38 shown in FIG. 13. Namely, gears 91 and 92 sequentially engage with the motor pinion 38*a*. A rocking plate 93 pivots on a central axle 91*a* of the gear 91, and the gear 92 pivots on this rocking plate 93. A fan-shaped gear 94 is engagable with a pinion 92*a* of the gear 92. The fan-shaped gear 94 pivots on a fixed axle 94*a*, and a connecting bar 94*b* is formed integral therewith.

As explained before, the gear 92 pivots by means of the rocking plate 93, and the fan-shaped gear 94 engages with the pinion 92*a*. Therefore, when the ribbon feed motor 38 is driven in reverse and the motor pinion 38*a* rotates in the anti-clockwise direction, the pinion 92*a* is pushed against the fan-shaped gear 94 and, therefore, transmits rotation in the forward direction when the ribbon feed motor 38 feeds the ribbon. When the motor pinion 38*a* rotates in the clockwise direction, the rocking plate 93 is rocked in the direction away from the fan-shaped gear 94, and as a result the pinion 92*a* does not engage with the fan-shaped gear 94 and rotation is not transmitted.

Figure 13:
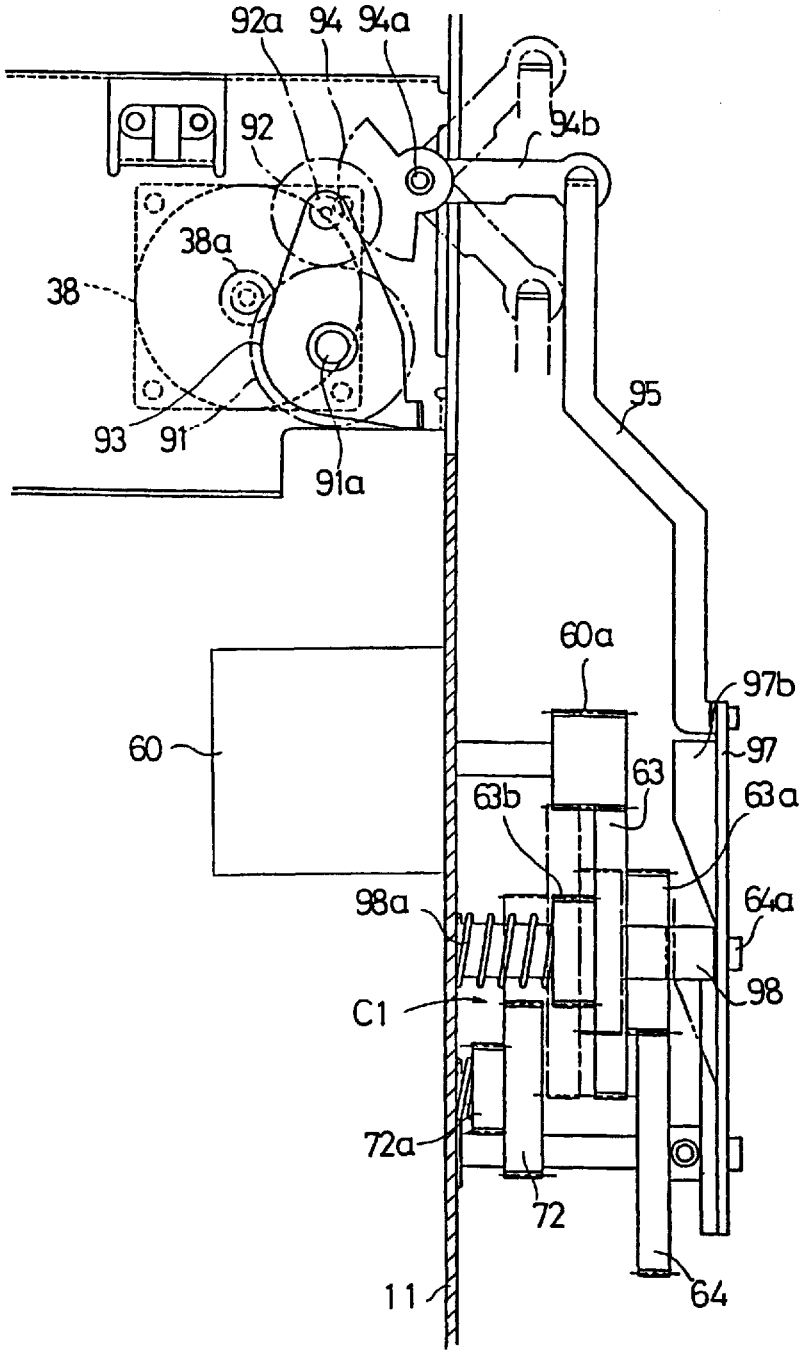
FIG. 13 is a cross-sectional view illustrating one part of the switching lever apparatus.

As shown in FIG. 12, a clutch connecting bar 95 of the clutch mechanism C1 connects with the tip portion of the connecting bar 94*b*, and a connecting bar 96 for switching further connects with this connecting bar 94*b*. The clutch connecting bar 95 connects the clutch mechanism C1 when the roller friction switching apparatuses 7 and 8 described previously are operated and transmit the rotation force of the paper feed motor 60. As shown in FIGS. 12 and 13, a clutch lever 97 connects with the bottom tip of the connecting bar 95. The clutch lever 97 pivots on a central axis 64*a* of the drive gear 64 of the paper feed roller 61. A guide groove 97*a* is provided at the end portion of clutch lever 97. Interfitted in the guide groove 97*a* is a central axle 69*a* of the gear 69 which engages with the gear 64. At the other end of the clutch lever 97, a cam 97*b* is formed. As shown in FIG. 13, the gear 63 which engages with the motor pinion 60*a* of the paper feed motor 60 slidably pivots in the axial direction on a central axle 98. Normally, when the pinion 63*b* and the gear 72 are separated by means of the spring force of spring 98*a*, the pinion 63*a* and the gear 64 are engaged.

When the connecting bar 95 drops by means of the connecting bar 94*b*, as indicated by the dotted line, the cam 97*b* pushes the gear 63 up against the spring force of the spring 98*a*, separating the engagement of the pinion 63*a* and the gear 64 and engaging the pinion 63*b* and the gear 72. The connecting bars 94*b*, 95 and 96 are forced upwards by the spring 99 (see FIG. 12).

Figure 14:
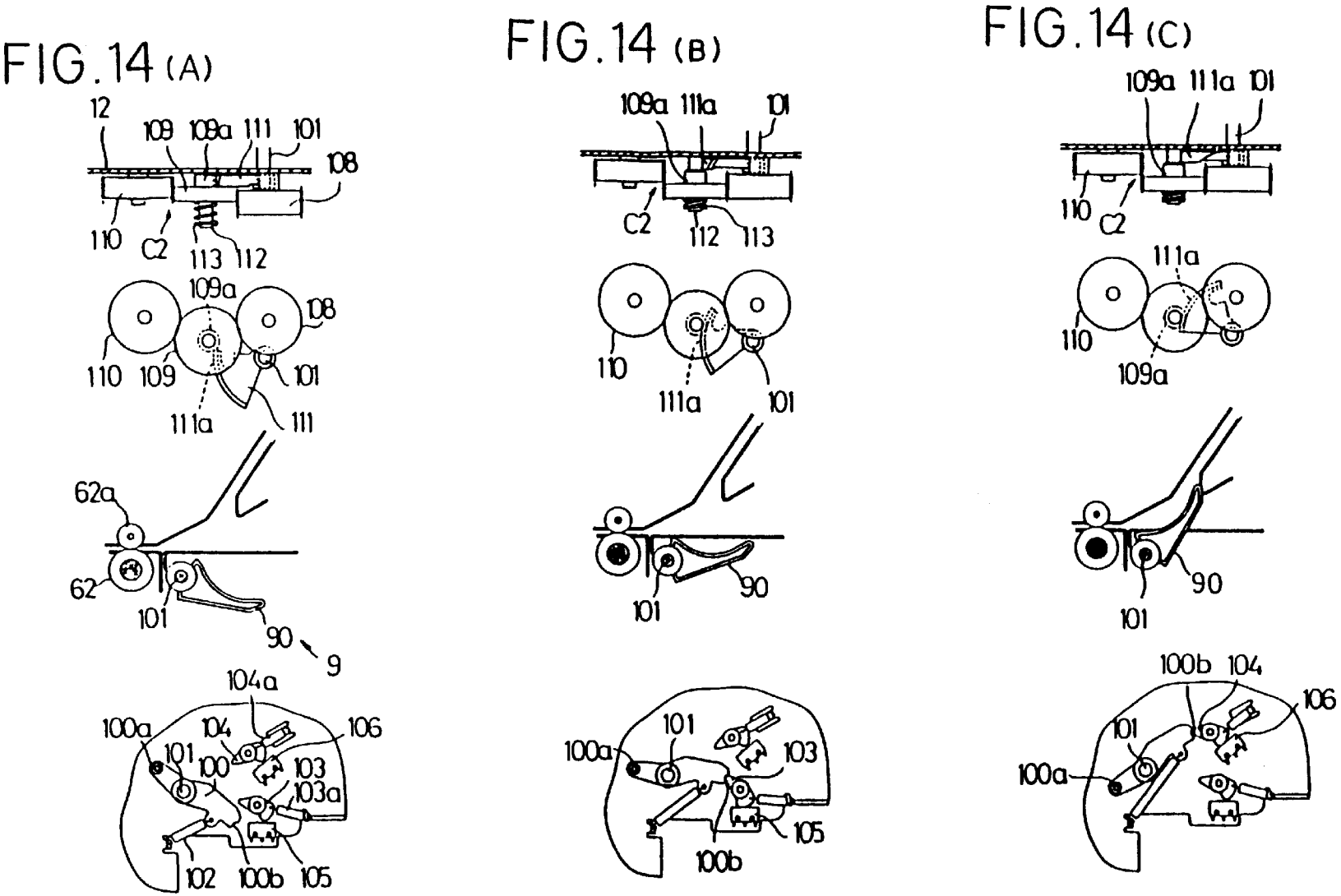
FIG. 14, (A), (B), and (C), are front views showing operations of the switching lever apparatus and operations of other portions interlinked therewith.

The connecting bar 96 for switching drives a drive lever 100 which switches the switching lever 90 to three levels, and as shown in FIG. 14, the switching lever 90 and the drive lever 100 are fixed to the same central axle 101 and operate integrally. A spring 102 is attached to the drive lever 100, and a connecting pin 100*a* protrudes from one end of the drive lever 100 and slidably interfits in a long groove 96*a* provided at a lower end portion of the connecting bar 96. A stopper. portion 100*b* is formed in the other end portion of the drive lever 100. The stopper portion 100*b* stops at one end portion of angling levers 103 and 104 to position them. When in this state, the other end portions of the angling levers push microswitches 105 and 106 to place the switches in an on state. Springs 103*a* and 104*a* are attached to the angling levers 103 and 104 and when the stopper portion 100*b* is not stopped against the positioning levers 103 and 104 the pressure on the microswitches 105 and 106 is released by the spring force and the switches are placed in an off state. In FIG. 12 where the drive lever 100 falls to the lowermost position by means of the connecting bar 96, the stopper portion 100*b* of the drive lever passes through both angling levers to a position thereabove. In such situations, both angling levers 103 and 104 receive the spring force of the springs 103*a* and 104*a* in a neutral position and both switches 105 and 106 are off.

As shown in FIG. 11, at the external surface of the side plate 12, gears 108, 109 and 110 are sequentially engagable with a gear 107 provided at a protruding end of the axle of the paper feed roller 62 protruding from the side plate 12. The gear 110 is a driving gear for the cut sheet feeder 21 and the continuous sheet tractor feeder 22 shown in FIG. 1 and FIG. 2, respectively. A detailed description of which will be given below.

A clutch mechanism C2 is provided between the gear 109 and the gear 110 and is connected/disconnected by the rocking action of a clutch lever 111. The clutch lever 111 is fixed to a central axle 101 of the switching lever 90 and the drive lever 100, and operates integral therewith. The gear 109 is supported slidably in the axial direction by an axle 112 as shown in FIG. 14 and is forced toward the left side plate 12 by a spring 113. The clutch lever 111 is fan-shaped at a tip portion thereof and has a cam portion 111*a* having an inclined surface. Referring to FIG. 11, a cam portion 111*a* engages with a boss portion 109*a* of the gear 109, and can push this upward against the spring 113. A gear 114 meshes with the gear 109. A belt 115 is wound between a pulley 114 provided on this gear 114 and a pulley 123*a* provided on the paper ejection roller 123 (see FIG. 1), and transmits the rotation of the paper feed motor 60 to the paper ejection roller 123.

When the switching lever apparatus 9 operates, the ribbon feed motor 38 is temporarily rotated in reverse. After reaching the state shown in FIG. 12 this motor is rotated in the forward direction, whereupon the connecting bars 95 and 96 are freed. Both connecting bars rise by means of the spring force of the spring 99, and engagement of the pinion 63*b* and the gear 72 in the clutch mechanism C1 is separated. Also, the drive lever 100 is freed and rocks in the clockwise direction due to the spring force of the spring 102. At this time the angling levers 104 and 103 override against this spring force and the drive lever 100 is in a state where it moves down to the right as shown in FIG. 14(A). The switching lever 90 and clutch lever 111 also change position due to the rotation of the central axle 101 as well as the drive lever 100. At the same time that the switching lever 90 reaches the lower stage position, the cam portion 111*a* of the clutch lever 111 separates from the boss portion 109*a*. Therefore, the gears 109 and 110 15 engage, the clutch mechanism C2 is closed, and the rotation from the paper feed motor 60 is transmitted to the gear 110. Since the gear 110 is rotatably driven, rotation is transmitted to the cut sheet feeder 21 and the rear tractor 22 and the usage states illustrated by FIG. 1 and FIG. 2 are reached.

When the ribbon feed motor 38 is driven in reverse, as described previously, the fan-shaped gear 94 is rotated in the clockwise direction, and the connecting bars 95 and 96 fall and move to the middle position shown by the solid line in FIG. 13. At this position of the connecting bar 95, the clutch mechanism C1 is still in an open clutch state. The drive lever 100 rocks in the anti-clockwise direction as shown in FIG. 14(B) due to the drop of the connecting bar 96 to the middle stage. In addition, the stopper portion 100*b* is stopped against the angling lever 103 and that position is maintained. Simultaneously, the microswitch 105 is switched on and thereby the reverse rotation of the ribbon feed motor 38 is terminated. At this position, the switching lever 90 is at the middle stage position, engagement of the gear 109 and the gear 110 is released due to the clutch lever 111 raising the boss portion 109*a* of the gear 109, and the clutch mechanism C2 is cut off. Consequently, the fastest rotation is not transmitted to the gear 110 and accordingly the cut sheet feeder 21 and the rear tractor 22 cannot be driven. Therefore, at this time, the printer is in the usage states illustrated by FIG. 3 and FIG. 4.

When the ribbon feed motor 38 is again driven in reverse, the fan-shaped gear 94 is rotated in the clockwise direction as described previously. Thus, the connecting bars 95 and 96 fall further and move to the lower stage position shown by the dotted line in FIG. 13. At this position of the connecting bar 95, the gear 63 disengages, the pinion 63*b* and the gear 72 engage, the clutch mechanism C1 is closed, the rotation from the paper feed motor 60 is transmitted to the gear 75 of FIG. 12, and driving of the roller friction switching apparatuses 7 and 8 becomes possible.

At the same time that the drive lever 100 rocks in the anti-clockwise direction as shown in FIG. 14(C) due to the drop of the connecting bar 96 to the lower stage, the stopper portion 100*b* is stopped against the angling lever 104, and that position is maintained. The microswitch 106 is switched on and reverse rotation of the ribbon feed motor 38 is terminated. At that position, the switching lever 90 is at the upper stage position, engagement of the gear 109 and the gear 110 is released due to the clutch lever 111 raising the boss portion 109*a* of the gear 109, and the clutch mechanism C2 is in a cut-off state.

FIG. 15(A) and (B) show states wherein the cut sheet feeder 21 and the rear tractor 22 are installed and driven. As previously described, the guide pins 18 and 19 protrude from both side plates 11 and 12. As shown in FIG. 1 and FIG. 15(A), the guide grooves 21*a* and 21*b* are provided in the cut sheet feeder 21. The guide grooves 21*a* and 21*b* are formed in a shape which open downward. Consequently, at the same time that the cut sheet feeder 21 stops against the guide pins 18 and 19, the guide groove 21*b* engages with the guide pin 19 from the top. Thus, installation of the cut sheet feeder is complete. In this installed state, a trailing gear 21*c* fixedly provided in the cut sheet feeder 21 engages with the gear 110. Therefore, the rotation of the trailing gear 21*c* is transmitted to a pinking roller 21*d* which contacts the cut sheets P1, and feeding out of the cut sheets P1 is possible.

Also, as shown in FIG. 2 and FIG. 15(B), guide grooves 22*a* and 22*b* are provided in the rear tractor 22. The guide groove 22*a* is formed in a shape which opens toward the front and the guide groove 22*b* is formed in a shape which opens downward. Consequently, when the rear tractor 22 stops against the guide pins 18 and 19, the guide groove 22*a* firstly engages with the guide pin 18 from the rear toward the front. The rear tractor 22 is rotatable about the guide pin 18, and the guide pin 19 smoothly engages with the guide groove 22*b* which opens downward. Thus, installation of the rear tractor 22 is completed. In this installed state, a trailing gear 22*c* of the rear tractor 22 is such that it engages with the gear 110, therefore feeding out of the continuous paper P2 is possible by means of the rotation of the trailing gear 22*c*.

Also, where the cut sheets P3 shown in FIG. 3 are feed in from the front, the cut sheets P3 may be inserted between the paper feed roller 61 and the trailing roller 61*a* by hand. Finally, as shown in FIG. 4, when the front tractor 23 is used, it must be placed in a state inclined upward toward the right. As illustrated by FIG. 1 and FIG. 4, the front tractor 23 has three rocking configurations centering on the shaft 23*a*.

A configuration modifying apparatus 130 of the front tractor 23 is shown in FIGS. 11 and 12. Namely, a trailing roller 23*d* is provided on an axle 23*c* of the trailing gear 23*b* of the front tractor 23. Also, in the side plates 11 and 12, a shaft hole 131 for receiving the shaft 23*a* and a guide hole 132 which is fan-shaped due to an arc centering on the shaft hole are provided. The axle 23*c* of the trailing gear 23*b* is movable within the guide hole 132. A spring 133, one end of which is fixed, flexibly contacts the axle 23*c* and forces it downward. As a result, the front tractor 23 normally has a configuration wherein it declines toward the right to the state shown in FIG. 1 due to the spring 133.

The outer circumference of the eccentric cam 76 in the roller friction switching apparatus 7 is a cam face. Specifically, intermediate diameter cam faces 76*e* and 76*e* are provided on both sides around a large diameter cam face 76*d*. The intermediate cam faces 76*e* and 76*e* and the small diameter cam face serve as stage sections 76*f* and 76*f*. The roller 23*d* flexibly contacts the cam faces 76*d* to 76*f* by means of the spring force of the spring 133.

Since it is of such a structure, as illustrated in FIG. 10, the following four modes are produced by closing the clutch mechanism C1 and transmitting the motor drive force to the gear 75. Namely, in the state of FIG. 10(A), the roller 23*d* falls into the stage section 76*f* of the eccentric cam 76 and as a result the front tractor 23 has a configuration wherein it inclines downward to the right as shown in FIG. 1. At this time the trailing gear 23*b* does not engage with the pinion 69*b* of the gear 69, and consequently the continuous paper P4 cannot be fed out from the front tractor 23 and is, therefore, in the usage mode for the cut sheet feeder 21.

When the gear 75 is rotated, the roller 23*d* reaches the state shown in FIG. 10,(B), where the roller 23*d* contacts the intermediate diameter cam face 76*e*. As a result, the front tractor 23 is in a horizontal configuration as shown in FIG. 2. Also at this time, the trailing gear 23*b* does not engage with the pinion 69*b* of the gear 69. Consequently, the continuous paper P4 cannot be fed out from the front tractor 23 and, therefore, the appropriate feeder is from the continuous sheet tractor feeder 22 as shown in FIG. 2.

When the gear 75 is rotated further, the roller 23*d* reaches the state shown in FIG. 10(C), where the roller 23*d* slidably contacts the large diameter cam face 76*d*. As a result the front tractor 23 is in a configuration wherein it inclines upward to the right as shown in FIG. 4. At this time, since the trailing gear 23*b* engages with the pinion 69*b* of the gear 69, the trailing gear 23*b* of the front tractor 23 is driven and the continuous paper P4 can be fed out.

When the gear 75 is rotated further, the roller 23*d* reaches the state shown in FIG. 10(D), the roller 23*d*, once again, slidably contacting the intermediate diameter cam face 76*e*. As a result, the front tractor 23 is in a horizontal configuration as shown in FIG. 3. At this time, the trailing gear 23*b* does not engage with the pinion 69*b* of the gear 69 and, consequently, the continuous paper P4 cannot be fed out from the front tractor 23. Thus, the usage mode is for hand operation.

When paper is being fed in the above embodiment, the trailing rollers 61*a* and 62*a* are continuously flexibly in contact with the paper feed rollers 61 and 62 on the drive side due to the spring force. This flexible contact force is switched between two stages of strength by the roller friction apparatuses 7 and 8. The apparatuses 7 and 8 can also switch the clamping pressure on the paper. In one position, the rollers 61*a* and 62*a* contact the rollers 61 and 62 and in the other position, they are somewhat separated from the rollers 61 and 62, thus facilitating switching the clamping pressure of the paper.

What is claimed is:

1. A printer comprising:

a paper feed roller and a trailing roller for clamping and conveying paper;

a friction switching mechanism for changing a paper clamping pressure between said two rollers;

a paper feed motor for driving said paper feed roller;

a clutch mechanism for transmitting a driving force of said paper feed motor to said friction switching mechanism;

a printing head;

a platen;

an ink ribbon inserted between said printing head and said platen;

a ribbon feed motor for driving said ink ribbon; and a drive force transmission mechanism for transmitting an inverse drive force of said ribbon feed motor to said clutch mechanism.

2. A printer as in claim 1, wherein said friction switching mechanism comprises:

a rockably and displaceably supported switching lever connected to the trailing roller;

a slide lever having a cam engaged with the switching lever for supporting and regulating the rocking of the switching lever in a plurality of rocking positions, said slide lever being driven by the driving force of said paper feed roller via said clutch mechanism.

3. A printer according to claim 2, further comprising an additional switching lever for switching said paper conveyance path between a plurality of levels, wherein said ribbon feed motor serves as a driving force for said additional switching lever.

4. A printer according to claim 1, further comprising:

a paper conveyance path for conveying paper between said paper feed roller and said trailing roller; and a switching lever for switching said paper conveyance path between a plurality of levels, wherein said ribbon feed motor serves as a driving force of said switching lever.

* * * * *

UNITED STATES PATENT AND TRADEMARK OFFICE

CERTIFICATE OF CORRECTION

PATENT NO. : 5,888,000

DATED : March 30, 1999

INVENTOR(S) : Tadashi Yasuoka

It is certified that error appears in the above-identified patent and that said Letters Patent is hereby corrected as shown below:

On the title page, insert

--[73] Assignee: Seiko Precision Inc., Tokyo, Japan--

Signed and Sealed this

Third Day of August, 1999

*Attest:*

*Attesting Officer*

Q. TODD DICKINSON

*Acting Commissioner of Patents and Trademarks*